US010530089B2

(12) United States Patent
Raab et al.

(10) Patent No.: US 10,530,089 B2
(45) Date of Patent: Jan. 7, 2020

(54) ELECTRICAL CONTACT DEVICE, ELECTRICAL CONTACT UNIT AS WELL AS ELECTRICAL CONNECTOR

(71) Applicant: TE Connectivity Germany GmbH, Bensheim (DE)

(72) Inventors: Stefan Raab, Nordlingen (DE); Christoph Goppel, Bechhofen (DE); Christian Bergmann, Windsbach (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 15/460,839

(22) Filed: Mar. 16, 2017

(65) Prior Publication Data

US 2017/0271802 A1 Sep. 21, 2017

(30) Foreign Application Priority Data

Mar. 16, 2016 (DE) ..... 10 2016 104 828

(51) Int. Cl.

| | |
|---|---|
| ***H01R 13/432*** | (2006.01) |
| ***H01R 4/18*** | (2006.01) |
| *H01R 13/24* | (2006.01) |
| *H01R 13/426* | (2006.01) |
| *H01R 13/422* | (2006.01) |
| *H01R 33/08* | (2006.01) |
| *H01R 13/11* | (2006.01) |

(52) U.S. Cl.

CPC ..... *H01R 13/432* (2013.01); *H01R 4/185* (2013.01); *H01R 13/114* (2013.01); *H01R 13/245* (2013.01); *H01R 13/422* (2013.01); *H01R 13/426* (2013.01); *H01R 33/0845* (2013.01)

(58) Field of Classification Search

CPC .. H01R 13/245; H01R 13/422; H01R 13/426; H01R 33/0845; H01R 13/432

USPC ..... 439/748, 746, 872

See application file for complete search history.

(56) References Cited

U.S. PATENT DOCUMENTS

| | | | | |
|---|---|---|---|---|
| 4,620,766 A | | 11/1986 | Leonard | |
| 4,726,792 A | * | 2/1988 | Shindo | H01R 13/428 439/748 |
| 5,741,162 A | | 4/1998 | Alois et al. | |
| 5,951,336 A | * | 9/1999 | Seko | H01R 13/432 439/745 |
| 6,165,026 A | * | 12/2000 | Sugie | H01R 13/432 439/746 |

(Continued)

FOREIGN PATENT DOCUMENTS

DE 102014216864 2/2016

OTHER PUBLICATIONS

European Search Report, dated Jul. 27, 2017, 10 pages.
German Office Action, dated Oct. 28, 2016, 10 pages.
Abstract of DE102014216864, dated Feb. 25, 2016, 1 page.

*Primary Examiner* — Abdullah A Riyami
*Assistant Examiner* — Justin M Kratt
(74) *Attorney, Agent, or Firm* — Barley Snyder

(57) ABSTRACT

An electrical contact includes a contact body and a contact spring. The contact spring is disposed in the contact body and has a locking arm locking the contact spring in a housing. The locking arm moves in a vertical direction away from the contact body when a withdrawal force acting on the contact spring exceeds a retaining force of the contact spring.

23 Claims, 5 Drawing Sheets

(56) References Cited

U.S. PATENT DOCUMENTS

2004/0164471 A1* 8/2004 Hotea ..... H01R 13/113
267/158

* cited by examiner

ELECTRICAL CONTACT DEVICE, ELECTRICAL CONTACT UNIT AS WELL AS ELECTRICAL CONNECTOR

CROSS-REFERENCE TO RELATED APPLICATION

This application claims the benefit of the filing date under 35 U.S.C. § 119(a)-(d) of German Patent Application No. 102016104828.3, filed on Mar. 16, 2016.

FIELD OF THE INVENTION

The present invention relates to an electrical contact, and more particularly, to an electrical contact of an electrical connector.

BACKGROUND

Known electrical connectors transfer electrical currents, voltages, signals, and data with a large bandwidth of currents, voltages, frequencies, and data rates. In low, medium, or high voltage or current ranges, and in particular in the automotive industry, such connectors must guarantee the transfer of electrical power, signals, and data in hot, contaminated, humid, or chemically aggressive environments. Due to the large range of applications, a large number of specifically configured connectors are known.

Known electrical connectors throughout the range of applications have housings assembled with an electrical member, such as an electrical cable or a circuit board of an electrical component, for mating with a mating electrical connector. An electrical connector must reliably secure a contact within the housing for connecting to the electrical member. Furthermore, the electrical connector must reliably transmit electrical signals, and consequently, known electrical connectors have fasteners for detachably fastening to the mating electrical connector.

Electrical connectors and the contacts within the connectors are increasingly made smaller to save space, manufacturing costs, and weight. However, due to the miniaturization of electrical connectors, forces acting on, for example, a cable connected to the contact increasingly influence the locking of the contact within the housing of the electrical connector, detrimentally affecting an electrical connection.

SUMMARY

An object of the invention, among others, is to provide a contact of an electrical connector which cost-effectively resists a withdrawal force acting on a cable connected to the contact. The disclosed electrical contact includes a contact body and a contact spring. The contact spring is disposed in the contact body and has a locking arm locking the contact spring in a housing. The locking arm moves in a vertical direction away from the contact body when a withdrawal force acting on the contact spring exceeds a retaining force of the contact spring.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
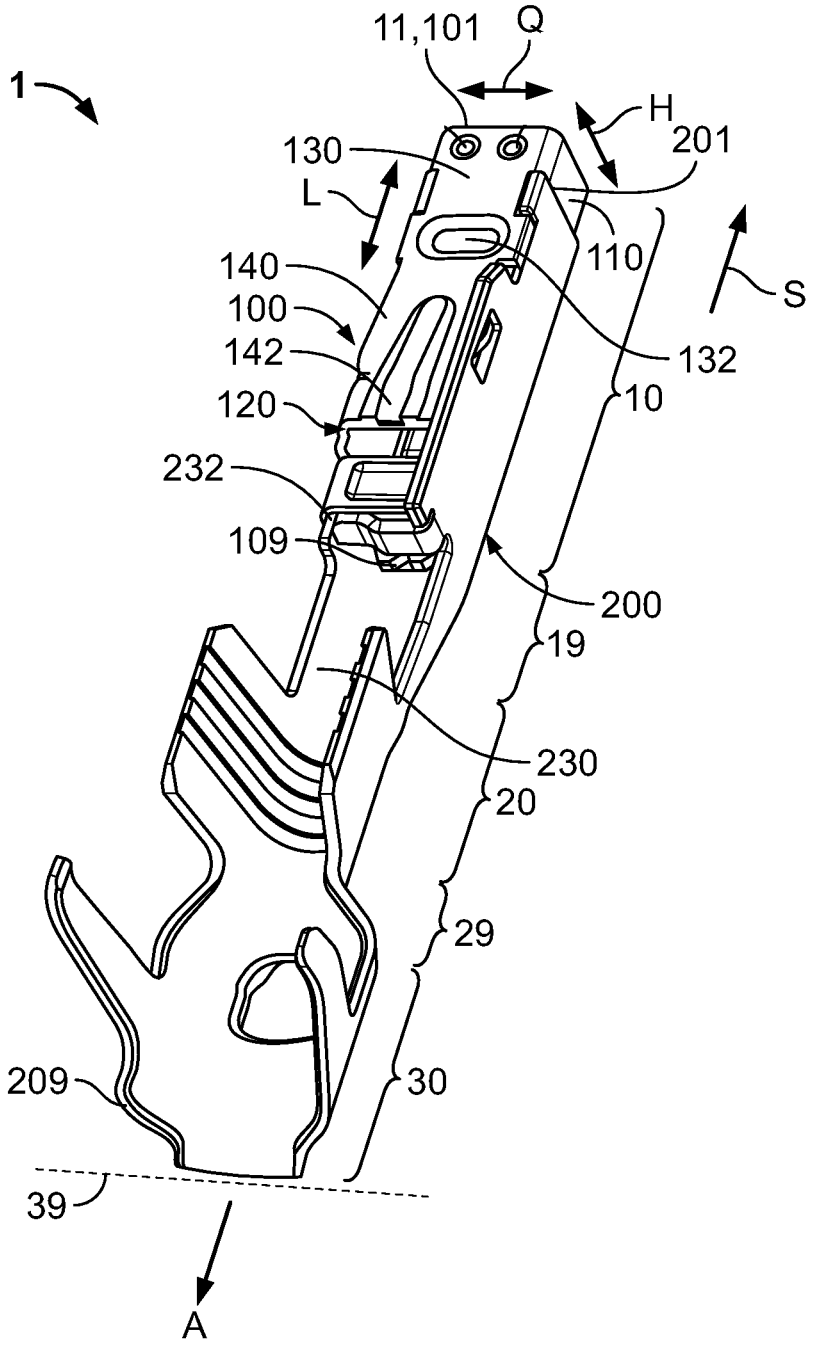
FIG. 1 is a perspective view of a contact according to the invention.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

An electrical contact 1 according to the invention is shown generally in FIG. 1. The contact 1 has a longitudinal axis L, a transverse axis Q, and a vertical axis H, wherein each axis L, Q, H comprises two directions. The longitudinal axis L is aligned with an insertion direction S and a withdrawal direction A of the contact 1. The contact 1, as shown in FIG. 1, has a contact spring 100 and a contact body 200. The contact spring 100 and the contact body 200 can be attached together or can be integrally formed. In embodiments in which the contact spring 100 is attached to the contact body 200, the contact spring 100 and contact body 200 are attached by welding, soldering, gluing, or form-fitting. In embodiments in which the contact spring 100 and contact body 200 are integrally formed, they are stamped from a metal sheet.

Starting at an insertion face 11 of the contact 1 shown in FIG. 1 and moving in the withdrawal direction A, the contact 1 including the contact spring 100 and the contact body 200 has a contact region 10, a connection region 20, and a fastening region 30. The contact region 10 contacts a counter contact and, in the contact region 10, the contact spring 100 is disposed in the contact body 200. The connection region 20 is crimped to an electrical conductor or braid of a cable, such as a copper or aluminum cable. The fastening region 30 is crimped to an insulation of the cable. Both the connection region 20 and the fastening region 30 are only constituted by the contact body 200. As shown in FIG. 1, a first transition region 19 is disposed between the contact region 10 and the connection region 20, and a second transition region 29 is disposed between the connection region 20 and the fastening region 30. The contact 1 can be disposed on and separated from a carrier strip 39.

After crimping, the connection region 20 and fastening region 30 can be referred to as a crimp sleeve 20, 30. The cable crimped in the crimp sleeve 20, 30 of the contact 1 may be referred to as a prefabricated cable. The contact 1 in the shown embodiment is a socket or plug contact 1. A counter contact mating with the contact 1 may be a tab or a pin. In an alternative embodiment, the contact 1 may be a tab or a pin and the counter contact may be a plug or socket. The contact 1 according to the invention may be disposed in an electrical connector connected to the cable.

The contact spring 100, as shown in FIG. 1, forms an electrical connection with a counter contact. In some embodiments, the contact spring 100 is partly coated. The contact spring 100 has at its front face 101 or insertion face 11 a contact spring collar 110 from which an integral locking arm 120 extends in the longitudinal direction L. A rear face 109 of the contact spring 100 is disposed within the contact body 200.

The contact body 200, as shown in FIG. 1, is substantially U-shaped in an un-crimped state. The contact spring 100 is disposed in a front section of the contact body 200. A front face 201 of the contact body 200 in the longitudinal direction L is disposed behind the contact spring collar 110 of the contact spring 100. A rear face 209 of the contact body 200 is formed from the free end of the fastening region 30 of the contact body 200.

The contact body 200, which is open on the top, is closed in the contact region 10 on the top by the contact spring 100 and, more particularly, by the locking arm 120. In an unstressed condition, at least one section of the locking arm 120 can move resiliently in both vertical directions H. The locking arm 120 has an attached end 130 and a free end 140. The attached end 130 merges at one side, integrally in the shown embodiment, into the contact spring collar 110 in the longitudinal direction L. A bending point 139, shown in FIG. 2, of the locking arm 120 is disposed between the attached end 130 and the free end 140. The two ends 130, 140 form a bending angle $\alpha$ greater than 90°. The attached end 130, as shown in FIG. 1, has a first stiffening unit 132 extending substantially in the transverse direction Q. The free end 140 has a second stiffening unit 142 extending substantially in the longitudinal direction L.

The contact 1, as shown in FIGS. 2-5, is disposed in a contact chamber 310 of an electrical connector housing 300 wherein, in a fitted position of the contact unit 1 in the contact chamber 310, the contact unit 1 is locked in the contact chamber 310 by the locking arm 120. For this purpose, the housing 300 has a housing locking member 320, such as a wall or a protrusion. The locking arm 120 has a housing connection section 148 disposed on the free end 140. In a fitting position of the contact unit 1, the housing connection section 148 in the longitudinal direction L sits on the housing locking member 320. The housing connection section 148 has a contact locking member 149 such as a locking protrusion or a locking shoulder abutting the housing locking member 320 in the vertical direction H.

Figure 2:
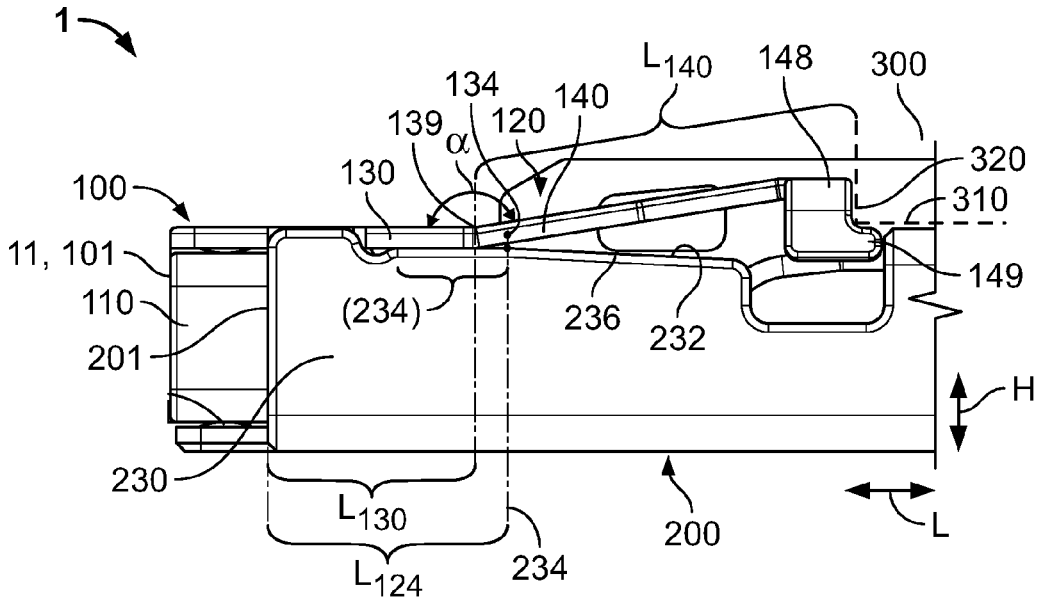
FIG. 2 is a side view of the contact of FIG. 1 with a bending point of a locking arm of the contact in a first position.
Figure 3:
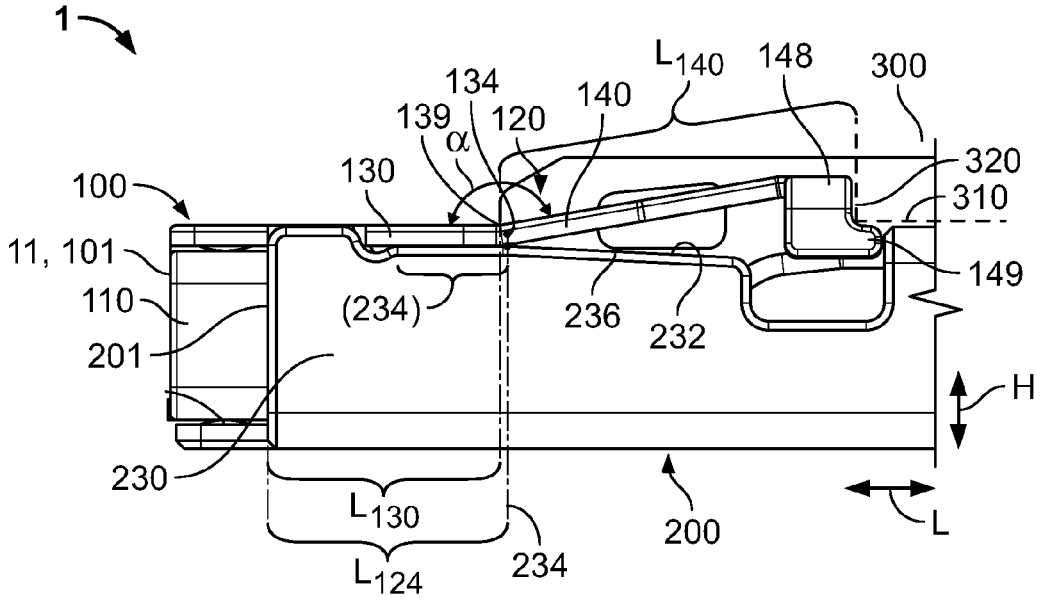
FIG. 3 is a side view of the contact of FIG. 1 with the bending point of the locking arm in a second position.
Figure 4:
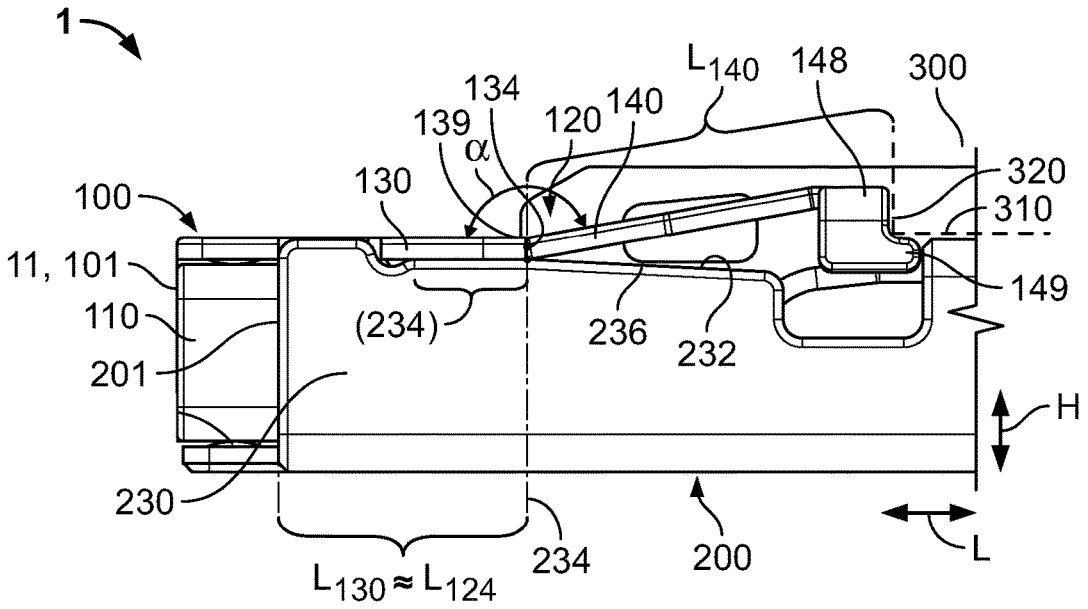
FIG. 4 is a side view of the contact of FIG. 1 with the bending point of the locking arm in a third position.
Figure 5:
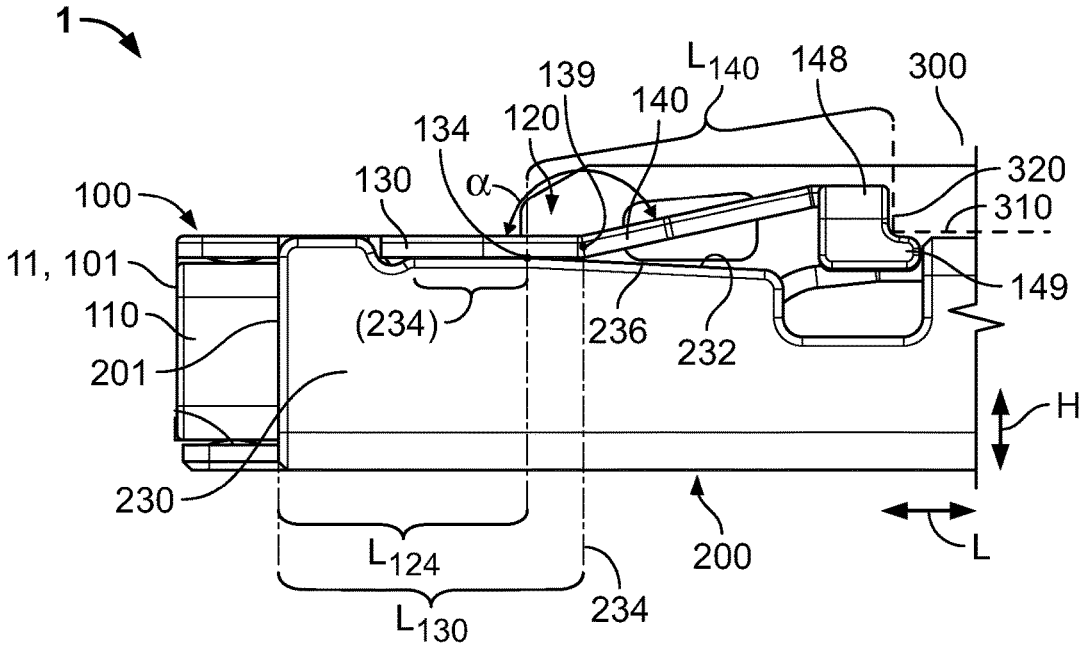
FIG. 5 is a side view of the contact of FIG. 1 with the bending point of the locking arm in a fourth position.

As shown in FIGS. 2-5, the attached end 130 of the locking arm 120 is disposed on an edge 232 of a wall 230 of the contact body 200. The edge 232 restricts a movement of the attached end 130 downwards. The edge 232 thus forms a body support 234 abutting a spring support 134 of the attached end 130. The support 134, 234 extends over a portion of or beyond a substantial length of the attached end 130; an endpoint of the body support 234 may be disposed in front of, as shown in FIGS. 2 and 3, directly at, as shown in FIG. 4, or behind, as shown in FIG. 5, the bending point 139. The support endpoint 234, as shown in FIGS. 2-5, is a bend 236 of the wall 230 in the vertical direction H downwards.

The position of the bending point 139 depends on the elastic and/or plastic deformability of the locking arm 120. The position of the bending point 139 is set such that the locking arm 120, when pulled or extracted out of the housing 300 in the withdrawal direction A, moves away from the contact 1 in the vertical direction H and is deformed in a direction of the insertion face 11.

There are two options for designing the locking arm 120, which can be used in each case on their own or in combination. The deformation of the locking arm 120 depends on a mass distribution between the attached end 130 and the free end 140. First, there is the option to design the attached end 130 and the free end 140 in the longitudinal direction L, transverse direction Q and/or vertical direction H using a characteristic value of the attached end 130 and/or the free end 140 or a quotient of them. The second option consists of determining a position of the bending point 139 with respect to the support endpoint 234 and thus designing the two ends 130, 140 in the longitudinal direction L, transverse direction and/or vertical direction H. The two options will be described in greater detail below.

A procedure in accordance with the first design option will now be described with reference to FIGS. 2-6.

A number of contacts 1 are provided which have a locking arm 120 with a defined length and a range of bending point 139 positions. It is experimentally determined how the locking arm 120 deforms when the contact 1 is extracted from the housing 300. In each instance, the contact 1 is locked in the housing 300 only by the locking arm 120.

The length of the locking arm 120 is a sum of a length of the attached end 130 and a length of the free end 140. The length L140 of the free end 140 is from the bending point 139 to the housing connection section 148. The length of the attached end 130 is measured from the bending point 139 to a connection point between the locking arm 120 and the contact spring 100. The connection point is defined as a point that does not significantly contribute to a spring characteristic of the locking arm 120. In the shown embodiment, the length L130 of the attached end 130 in the longitudinal direction L is from a connection point at the front face 201 to the bending point 139.

A large number of positions of bending points 139 as described above, are arranged in a large number of contacts 1, and each respective contact 1 is locked in a respective contact chamber 310 in a housing 300 and the respective contact unit 1 is pulled out of the contact chamber 310 by force in withdrawal direction A. In this case, a traction force can be measured while it is being withdrawn and a withdrawal force at which the locking arm 120 begins to deform and/or deforms elastically and/or plastically, when the withdrawal force exceeds a retaining force of the contact spring 100, is assigned to the respective contact 1.

After withdrawal of the respective contact 1, it is determined to what extent the locking arm 120 has behaved according to the desired criteria, for example, criteria such as a comparatively high elastic and/or plastic mechanical resistance, elastic and/or plastic deformation in vertical direction H, elastic and/or plastic deformation in the direction of the insertion face 11. At least one corresponding position of the bending point 139 is selected as preferable for such locking arms 120.

FIGS. 2-5 show four positions of bending points 139 in respective locking arms 120 of the contact 1, which is a 1.2 mm contact in the shown embodiments. In FIG. 2, the length L130 of the attached end 130 is equal to 1.69 mm±0.05 mm; in FIG. 3 the length L130 is equal to 1.89 mm±0.05 mm; in FIG. 4 the length L130 is equal to 1.95 mm±0.05 mm; and in FIG. 5 the length L130 is equal to 2.29 mm±0.05 mm.

Figure 6:
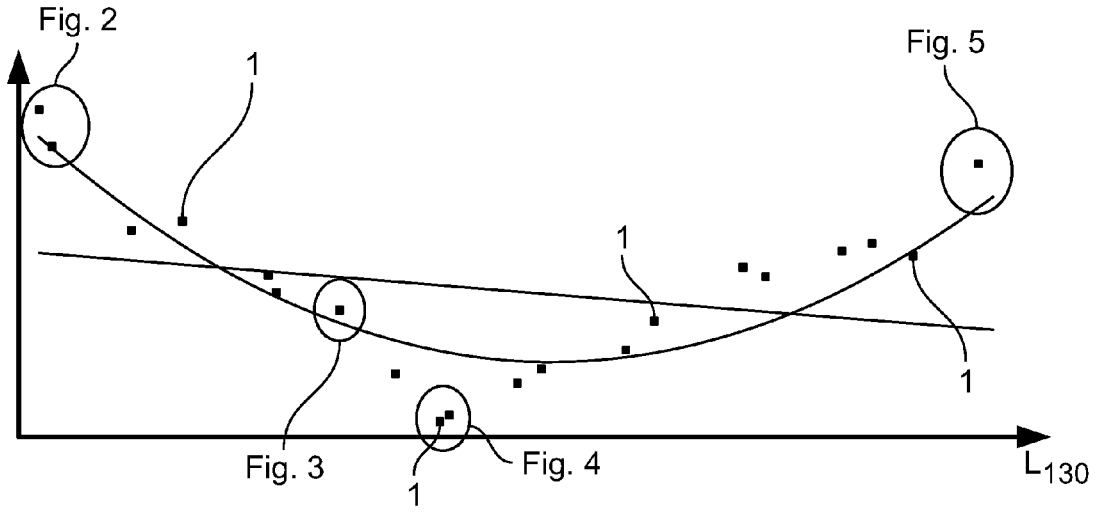
FIG. 6 is a graph of a deformation of the locking arm and a position of the bending point.

As shown in FIG. 6, a deformation length of the locking arm 120 is plotted over a respective overall length L130 of the attached end 130, wherein, in the coordinate system of FIG. 6, shorter deformation lengths are plotted towards the top. The higher a point representing a contact 1 is located in the coordinate system of FIG. 6, the less the locking arm 120 is deformed, which is desired. Thus, as shown in FIG. 6, the contacts 1 of FIGS. 2 and 5 are more suitable than those of FIGS. 3 and 4. In the case of comparatively small overall lengths L130 of the attached end 130, however, an undesirable effect occurs; the locking arm 120 is deformed elastically and plastically inwards into the contact unit 1. Thus, a contact unit 1, for example in accordance with FIG. 5, performs better. Consequently, in the present case, overall lengths L130 of the attached end 130 greater than approximately 2.1 mm±0.05 mm, and in some embodiments, greater than approximately 2.16 mm±0.05 mm or greater than approximately 2.3 mm±0.05 mm are used.

Lengths L130 of the attached end 130 allow the locking arm 120 to deform in the direction of the insertion face 11 and move away from the contact 1. The length L140 of the free end 140 is given by subtracting the length L130 of the attached end 130 from an overall length of the locking arm 120. In the shown embodiment, the overall length of the locking arm 120 is approximately 4.6 mm to approximately 5.0 mm, and may be approximately 4.8 mm; the contact 1 is a 1.0 mm to 1.4 mm contact. A ratio of the length L140 to the length L130 may be approximately 1.05 to approximately 1.5. The length L140 in various embodiments may be less than approximately 2.7 mm±0.05 mm, less than approximately 2.64 mm±0.05 mm, or less than approximately 2.5 mm±0.05 mm. Optimization according to other characteristic values of the attached end 130 and/or of the free end section 140 is also possible according to the present invention. Adjustment of the lengths L130 and L140 adjusts the elastic and/or plastic deformability of the locking arm 120 by adjusting the mass distribution of the locking arm 120 in the vertical direction H.

Figure 7:
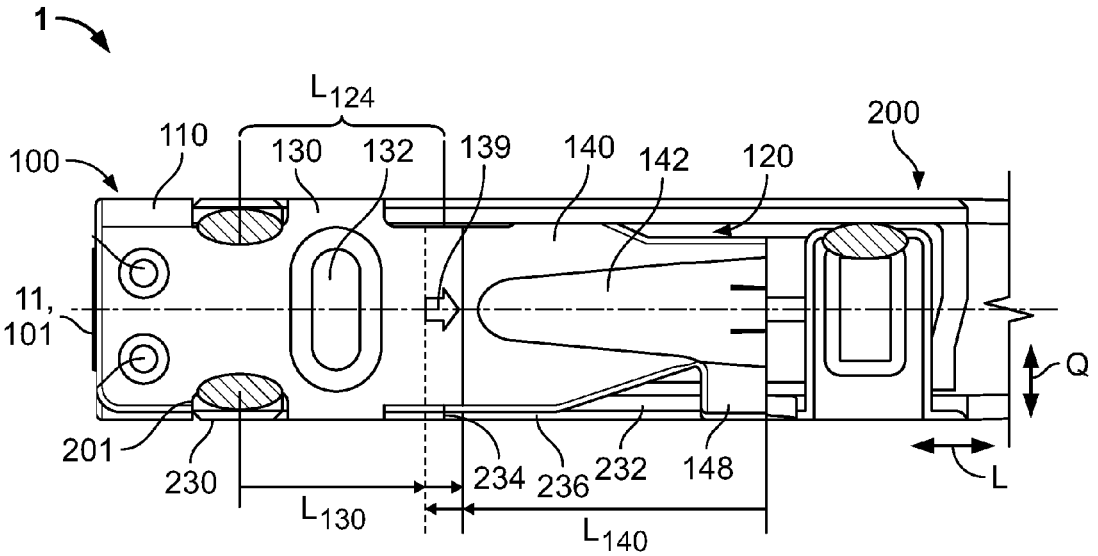
FIG. 7 is a top view of the contact of FIG. 1 with the bending point in a variable position.

A procedure in accordance with the second design option will now be described with reference to FIGS. 7 and 8.

The attached end 130 has a length L130 beginning at a welded connection point between the contact spring 100 and the contact body 200 and extending to the bending point 139. The free end 140 has a length L140 beginning at the bending point 139 and extending to the housing connection section 148.

The invention provides a formula to calculate the length L130 of the attached end 130 as a function of a longitudinal distance L124 of the endpoint of the body support 234 with respect to the connection point of the locking arm 120. The formula is L130=c*L124, wherein c is equal to or greater than 1.000. In various embodiments, c may be equal to or greater than approximately 1.01 to approximately 2.5. This formula is likewise applicable to 1.0 mm to 1.4 mm contacts 1, and also to other sized contacts 1.

If a contact 1 is made larger or smaller then it is possible, using the formula, to calculate the overall length L130 of the attached locking arm longitudinal end section 130 from a given longitudinal distance L124 of the endpoint of the body support 234, or to calculate the longitudinal distance L124 of the endpoint of the body support 234 from a given overall length L130 of the attached end 130, and to arrange a position of the bending point 139 in the locking arm 120 and/or a position of the endpoint of the body support 234 in the contact unit 1 accordingly.

The bending point 139 extends beyond the endpoint of the body support 234, i.e. the attached end 130 protrudes over and above the support 134/234. The attached end 130 protrudes over and/or above the support 134/234 or the endpoint of the body support 234, or has a distance from the bending point 139 to the support 134/234 or the endpoint of the body support 234 less than, equal to or more than: approximately 0.01 mm to approximately 1.8 mm.

Figure 8:
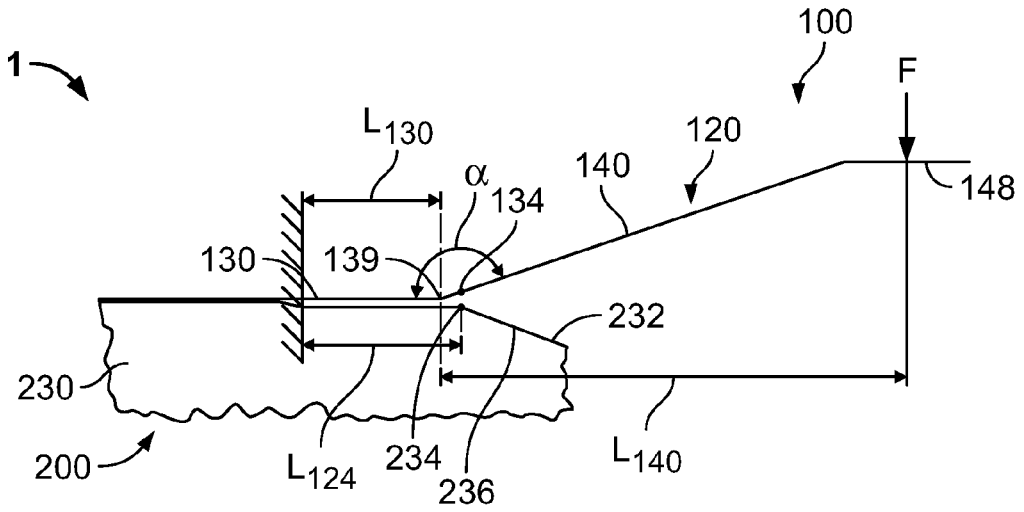
FIG. 8 is a schematic view of a force on the locking arm of the contact of FIG. 1.

The bend 236 of the edge 232 of the wall 230, which directly joins onto the support 134/234 or the endpoint of the body support 234 is formed in such a way that, when the free end 140 is subjected to and/or is pressed down by a force F as shown in FIG. 8, the bending point 139 touches the bend 236. Furthermore, the bend 236 is configured in such a way that, temporally after the bending point 139 touches the bend 236, the bend 236 functions as a support for the bending point 139. Here, the bending point 139 can roll off the bend 236.

Advantageously, in the contact 1 according to the invention, the position of the bending point 139 is optimized, leading to an improved interconnection of the locking arm 120 when it deforms and an increase in the permitted withdrawal force on a cable attached to the contact 1.

What is claimed is:

1. An electrical contact, comprising:

a contact body; and a contact spring connected to the contact body and having a locking arm locking the electrical contact in an electrical connector housing, the locking arm having an attached end attached to a contact spring collar of the contact spring and a free end connected to the attached end at a bending point, the attached end extending over the contact body and abutting an edge of a wall of the contact body in an undeformed state of the locking arm, the locking arm moving in a vertical direction away from the contact body when a withdrawal force acting on the contact spring exceeds a retaining force of the contact spring.

2. The electrical contact of claim 1, wherein the locking arm is deformed in a direction of an insertion face of the contact when the withdrawal force exceeds the retaining force.

3. The electrical contact of claim 1, wherein a deformability of the locking arm is adjusted by adjusting a shape of the locking arm.

4. The electrical contact of claim 3, wherein the deformability of the locking arm is adjusted by adjusting a mass distribution of the locking arm in the vertical direction.

5. The electrical contact of claim 4, wherein the deformability of the locking arm is an elastic deformability or a plastic deformability.

6. The electrical contact of claim 1, wherein the contact body and the contact spring are integrally formed.

7. The electrical contact of claim 1, wherein the locking arm is integrally formed with the contact spring.

8. The electrical contact of claim 1, wherein the locking arm is integrally formed with the contact spring collar of the contact spring.

9. The electrical contact of claim 1, wherein the attached end abuts the edge of the wall along a longitudinal direction of the locking arm.

10. The electrical contact of claim 1, wherein the edge of the wall of the contact body is a body support restricting movement of the attached end in the vertical direction toward the contact body.

11. The electrical contact of claim 10, wherein a deformability of the locking arm is adjusted by adjusting an endpoint of the body support.

12. The electrical contact of claim 11, wherein the deformability of the locking arm is adjusted by adjusting a length of the attached end with respect to a length of the free end.

13. The electrical contact of claim 12, wherein the attached end and the free end form a bending angle.

14. The electrical contact of claim 13, wherein the deformability of the locking arm is adjusted by adjusting a position of the bending point.

15. The electrical contact of claim 14, wherein the length of the attached end is calculated by a formula:

$L130=c*L124$, wherein

L124 is a longitudinal distance of the endpoint of the body support with respect to a connection point between the contact spring and the contact body, and the factor c is equal to or greater than approximately 1.0 to approximately 2.5.

16. The electrical contact of claim 12, wherein a ratio of the length of the free end to the length of the attached end is approximately 1.05 to approximately 1.5.

17. The electrical contact of claim 12, wherein the free end has a housing connection section abutting a locking member of the housing in a longitudinal direction of the contact.

18. The electrical contact of claim 17, wherein the housing connection section has a contact locking member abutting the locking member of the housing in the vertical direction.

19. The electrical contact of claim 12, wherein the attached end protrudes over the body support.

20. An electrical connector for a cable, comprising:

a housing; and an electrical contact including a contact body and a contact spring connected to the contact body and having a locking arm locking the electrical contact in the housing, the locking arm having an attached end attached to a contact spring collar of the contact spring and a free end connected to the attached end at a bending point, the attached end extending over the contact body and abutting an edge of a wall of the contact body in an undeformed state of the locking arm, the locking arm moving in a vertical direction away from the contact body when a withdrawal force acting on the contact spring exceeds a retaining force of the contact spring.

21. A prefabricated cable, comprising:

a cable; and an electrical contact connected to the cable including a contact body and a contact spring connected to the contact body, the contact spring having a locking arm locking the electrical contact in an electrical connector housing, the locking arm having an attached end attached to a contact spring collar of the contact spring and a free end connected to the attached end at a bending point, the attached end extending over the contact body and abutting an edge of a wall of the contact body in an undeformed state of the locking arm, the locking arm moving in a vertical direction away from the contact body when a withdrawal force acting on the contact spring exceeds a retaining force of the contact spring.

22. An electrical contact, comprising:

a contact body having a body support; and a contact spring connected to the contact body and having a locking arm locking the electrical contact in an electrical connector housing, the locking arm having an attached end attached to a contact spring collar of the contact spring and a free end and moving in a vertical direction away from the contact body when a withdrawal force acting on the contact spring exceeds a retaining force of the contact spring, the attached end and free end are connected at a bending point and form a bending angle, a deformability of the locking arm is adjusted by adjusting an endpoint of the body support that abuts the attached end, by adjusting a length of the attached end with respect to a length of the free end, and/or by adjusting a position of the bending point, the length of the attached end is calculated by a formula:

$L130=c*L124$, wherein

L124 is a longitudinal distance of the endpoint of the body support with respect to a connection point between the contact spring and the contact body, and the factor c is equal to or greater than approximately 1.0 to approximately 2.5.

23. An electrical contact, comprising:

a contact body having a body support; and a contact spring connected to the contact body and having a locking arm locking the electrical contact in an electrical connector housing, the locking arm moving in a vertical direction away from the contact body when a withdrawal force acting on the contact spring exceeds a retaining force of the contact spring, the locking arm having an attached end attached to a contact spring collar of the contact spring and protruding over and abutting the body support and a free end connected to the attached end, a deformability of the locking arm is adjusted by adjusting an endpoint of the body support and by adjusting a length of the attached end with respect to a length of the free end.

* * * * *